US009701031B1

(12) United States Patent
Martinez

(10) Patent No.: US 9,701,031 B1
(45) Date of Patent: Jul. 11, 2017

(54) SHEARS

(71) Applicant: Michael Anthony Martinez, Albuquerque, NM (US)

(72) Inventor: Michael Anthony Martinez, Albuquerque, NM (US)

( * ) Notice: Subject to any disclaimer, the term of this patent is extended or adjusted under 35 U.S.C. 154(b) by 31 days.

(21) Appl. No.: 14/988,346

(22) Filed: Jan. 5, 2016

(51) Int. Cl.
*B26B 13/22* (2006.01)
*B26B 13/06* (2006.01)
*B26B 13/12* (2006.01)
*B26B 3/00* (2006.01)

(52) U.S. Cl.
CPC ..... *B26B 13/22* (2013.01); *B26B 3/00* (2013.01); *B26B 13/06* (2013.01)

(58) Field of Classification Search
CPC ..... B26B 13/22; B26B 13/06; B26B 3/00
USPC ..... 30/146, 262
See application file for complete search history.

(56) References Cited

U.S. PATENT DOCUMENTS 208,467 A * 10/1878 Conover ..... B26B 13/285 30/261
4,333,235 A 6/1982 Howard
4,502,222 A 3/1985 Sargent
4,658,456 A * 4/1987 Tsai ..... B25B 7/00 7/135
5,063,671 A 11/1991 Huang
D359,890 S 7/1995 Wensley
5,463,814 A 11/1995 Stowell
6,418,626 B1 7/2002 Jang
6,915,575 B2 * 7/2005 Cerutti ..... B26B 17/00 30/186
7,424,777 B2 9/2008 Namvar
7,458,160 B2 12/2008 Escobar
D623,917 S 9/2010 Goetz
7,941,928 B2 5/2011 Fisher
D642,032 S 7/2011 Molina
D642,035 S 7/2011 Molina
D646,944 S 10/2011 Bhasin
8,079,150 B2 * 12/2011 Huang ..... A01G 3/02 30/254
D651,493 S 1/2012 Bhasin
8,105,335 B1 1/2012 Bentley
8,707,490 B1 * 4/2014 Pelton ..... B26B 1/00 30/123
D722,482 S * 2/2015 McLean ..... D8/57
D723,161 S 2/2015 Goldstein
8,959,777 B2 2/2015 Forman
(Continued)

*Primary Examiner* — Hwei C Payer
(74) *Attorney, Agent, or Firm* — Yorgos D. Marinakis

(57) ABSTRACT

A shears comprising a first lever and a second lever, each lever having a blade end and a handle end, wherein the first lever is s-shaped such that the upper handle is at a higher elevation than the first lever blade end, the upper handle front portion projecting upwardly above the upper handle medial portion for engagement with the web between the thumb and forefinger of a user's hand to limit forward movement of the hand along the upper handle but not projecting upwardly above the upper handle rear portion, the lower handle having a lower surface formed of a high-friction material that is downwardly convex and shaped and dimensioned to conform to the curled fingers of a user's hand, the shears further comprising a ripping blade detachably mountable to the first lever blade end, the shears further comprising handle stop with a spring for biasing the shears in the open position.

9 Claims, 8 Drawing Sheets

(56) References Cited

U.S. PATENT DOCUMENTS

| | | | | |
|---|---|---|---|---|
| 9,282,697 | B2 * | 3/2016 | Wu | A01G 3/02 |
| 9,498,875 | B2 * | 11/2016 | Nix | B25F 1/003 |
| 2008/0184567 | A1 * | 8/2008 | Jou | B26B 13/16 30/262 |
| 2009/0090010 | A1 * | 4/2009 | Lin | B26B 29/04 30/254 |
| 2011/0138631 | A1 | 6/2011 | Smith | |
| 2012/0137526 | A1 | 6/2012 | Forman | |
| 2014/0190015 | A1 | 7/2014 | Forman | |
| 2016/0031098 | A1 * | 2/2016 | Covel | B26B 13/005 30/226 |

* cited by examiner

SHEARS

CROSS-REFERENCE TO RELATED APPLICATIONS

Not applicable.

STATEMENTS REGARDING FEDERALLY SPONSORED RESEARCH AND DEVELOPMENT

Not applicable.

BACKGROUND

The embodiments of the present invention satisfy the needs of having a better shears that increases cutting speed, compression and efficiency, as well as diminishes operator hand and arm fatigue.

Information relevant to attempts to address these problems can be found in U.S. Pat. Nos. 8,959,777; 8,105,335; 7,941,928; 7,458,160; 7,424,777; 6,418,626; 5,463,814; 5,063,671; 4,502,222; 4,333,235; D723,161; D651,493; D646,944; D642,035; D642,032; D623,917; D469,323; D359,890; and U.S. Patent Application numbers 20140190015; 20120137526; 20110138631; which are not admitted to be prior art with respect to the present invention by its mention in this Background Section. However, it is desirable to have a better apparatus and/or method than is disclosed in the references.

Many shears use a thumb and finger loop design to open and close the scissor action. This loop design, depending on the inside circumference, can inhibit or prevent the user or operator from adequately placing their fingers in the loops; this is particularly the case if they are wearing work gloves, protective gloves or winter gloves. Loops diminish compressive power as compared to simpler bare lever designs.

Another negative effect of the loop-handle design is that the interior geometry of the loops will dictate a right hand operator, a left hand operator or an ambidextrous design. Yet operators in the field are often in emergency situations where they are unable to use their strong side for cutting. Ambidextrous design scissors, which may suffice for the operator's weak side, will severally diminish the cutting speed, compression and efficiency of the operator. Moreover, the negative byproduct of this loop-handle design is the operators reduced compression capabilities due to poor placement of the thumb and fingers on the handle loops. This loop-handle design diminishes cutting speed, compression and efficiency as well as promoting operator hand/arm fatigue.

Conventional shears have a cutting edge that measures 1½ inches in length. This cutting edge length reduces cutting speed and efficiency. Additionally, operator hand and arm fatigue in many cases can become an issue because of the lack of cutting efficiency.

Conventional shears may have a ripping blade requiring the operator to perform an initial scissor cut or knife cut before engaging the ripping blade. This is necessary because the ripping blades as they are designed do not allow for any way to perform an initial cut in a material.

Conventional shears typically require an additional tool to assemble and disassemble the shears if they need to be re-sharpened. This is also the case for the conventional trauma shears that might have a ripping blade attachment that can typically be removed only with an additional tool.

The problem with this design is that it forces the operators to carry additional tools into their work environments.

SUMMARY

The embodiments of the present invention are directed to a device and a method that satisfy the needs set out in the Background section.

The preferred embodiment of the present invention a shears having a first lever and a second lever, the first lever and the second lever being crossed and being pivotally interconnected by a king screw, each lever having a blade end and a handle end and being pivotally movable between open and closed conditions and normally biased to the open condition, the shears further comprising:

an upper handle connected to the handle end of the first lever and disposed for engagement in use with a thumb and palm of a user's hand, and a lower handle connected to the handle end of the second lever and disposed for engagement in use with fingers of a user's hand, the upper handle having a domed upper surface formed of a high-friction material and including an upper handle rear portion and an upper handle front portion and an upper handle medial portion between said upper handle front and rear portions, the upper handle front portion projecting upwardly above said upper handle medial portion for engagement with the web between the thumb and forefinger of a user's hand to limit forward movement of the hand along said upper handle, the lower handle comprising a lower surface formed of a high-friction material that is downwardly convex and shaped and dimensioned to conform to curled fingers of a user's hand, a lower handle rear portion comprising a diamond-shaped portion comprising an internal rectangular opening and a backwardly projecting removably insertable pointed conical member, wherein an upper handle rear portion terminal end fits snugly into a notch in a top of the diamond-shaped portion, the upper handle and the lower handle each further comprising a handle stop, the handle stops each comprising a recess for receiving a first spring to bias the shears to the open condition, wherein the two handle stops define both a first opening and a second opening between the upper handle and the lower handle, and the first spring, wherein the first lever is s-shaped such that the upper handle is at a higher elevation than the first lever blade end, wherein the lower handle is positioned on a same level as the second lever, and wherein the first lever blade end comprises a porpoise nose-shaped terminal end.

Optionally, the shears further comprises a lock for securing the blade ends together in a closed position, wherein the lock is pivotably mountable on the lower handle such that when the shears are in a closed position the lock is positioned adjacent a bend in the first lever.

Optionally, the lock is a lever lock.

Optionally, the blade ends are elongate.

Optionally, a cutting edge of an elongate blade end measures 2½ inches in length.

Optionally, the king screw is a thumbscrew.

Optionally, the shears further comprises a ripping blade detachably mountable to the first lever blade end.

Optionally, the ripping blade is detachably mountable to the first lever blade end by means of two thumbscrews.

Optionally, the ripping blade has an interior bottom that comprises a lead-in blade.

Some Advantages of the Embodiments of the Invention

The conventional shears does not require a lock because they are bias-closed designs. The embodiments of the present invention comprise a bias-open design that is spring-loaded to create constant tension on the operator's grip. The bias open design requires a locking mechanism to close the shears. The simplicity of the pad lever lock and its placement allows the operator to easily access and manipulate the opening and closing of the lock from any and all grip positions.

The embodiments of the present invention have a lead-in blade inside the bottom of the ripping blade. This allows the operator to perform an initial cut in the material and easily engage the ripping blade as needed. The porpoise nose-shaped portion is used to lift clothing, for example at a cuff, to facilitate cutting and ripping.

The embodiments of the present invention also have an ergonomically designed handle that is easily and comfortably gripped in a forward or backward, side to side, by either hand position. This ergonomic advantage is an advantage in part due to the glass breaking tool and the oxygen key attached to the lower handle. In an emergency, a user may not have time to position the tool in his hand. The diamond-shaped portion acts as a hand stop or guard to prevent a user's hand from pushing into glass when the pointed conical member is used to break glass. The second opening in the handles, in conjunction with the lock, functions as an attaching clip, such that the device can be clipped to a lanyard or belt loop without a carabiner.

The embodiments of the present invention also have thumbscrews allowing the operator maximum contact and torque when assembling or disassembling the shears or the ripping blade. Should a tool be needed to remove one of these customized screws then the heads of these thumbscrews will fit any typical key thickness or any coin up to a nickel thickness.

The diamond-shaped portion has an internal rectangular opening that functions as an oxygen wrench, and a backwardly projecting removably insertable pointed conical member that functions as a glass breaking tool.

DRAWINGS

These and other features, aspects and advantages of the embodiments of the method will become better understood with reference to the following description, appended claim and accompanying drawings where:

REFERENCE NUMERALS FOR DRAWINGS

Figure 1:
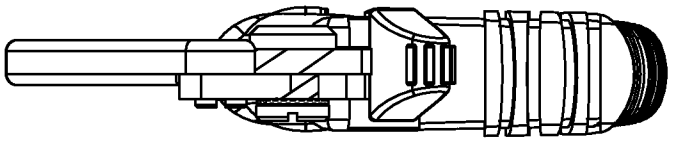
FIG. 1 shows a front elevation view of an embodiment of the invention.
Figure 2:
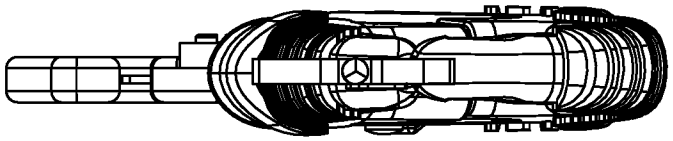
FIG. 2 shows a rear elevation view of an embodiment of the invention.
Figure 3:
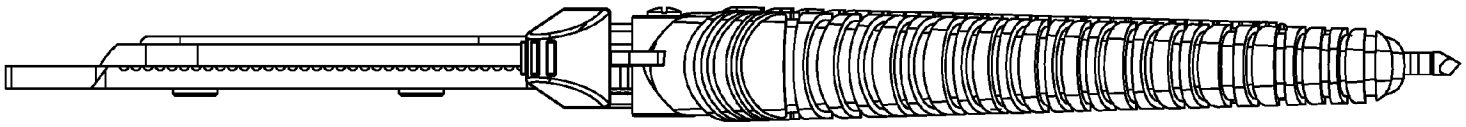
FIG. 3 shows a top plan view of an embodiment of the invention.
Figure 4:
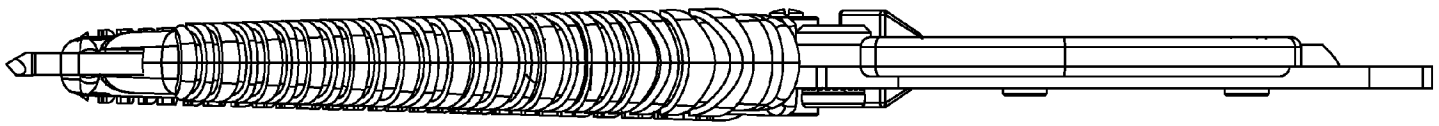
FIG. 4 shows a bottom plan view of an embodiment of the invention.
Figure 5:
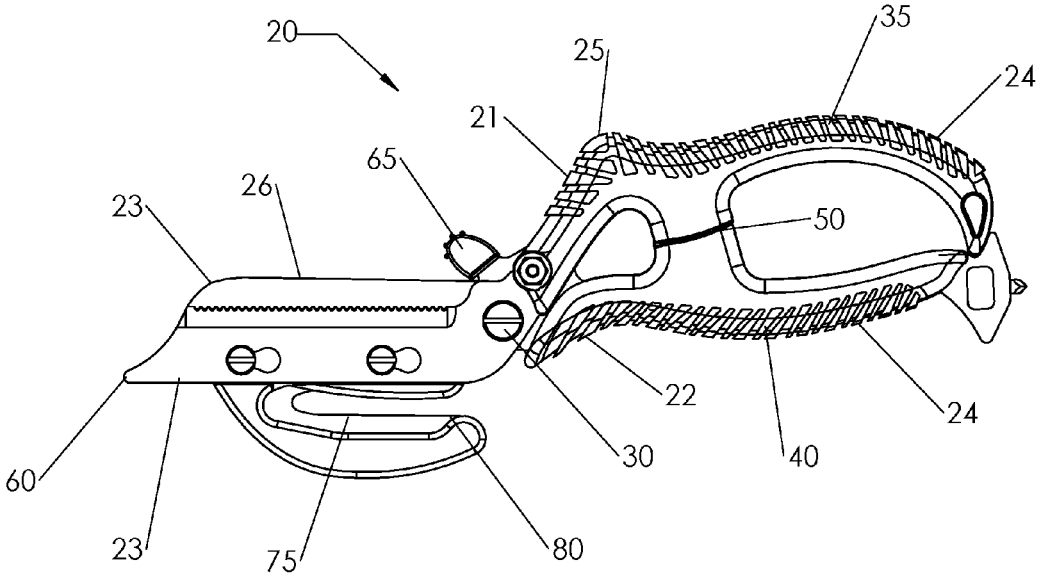
FIG. 5 shows a left side elevation view of an embodiment of the invention.
Figure 6:
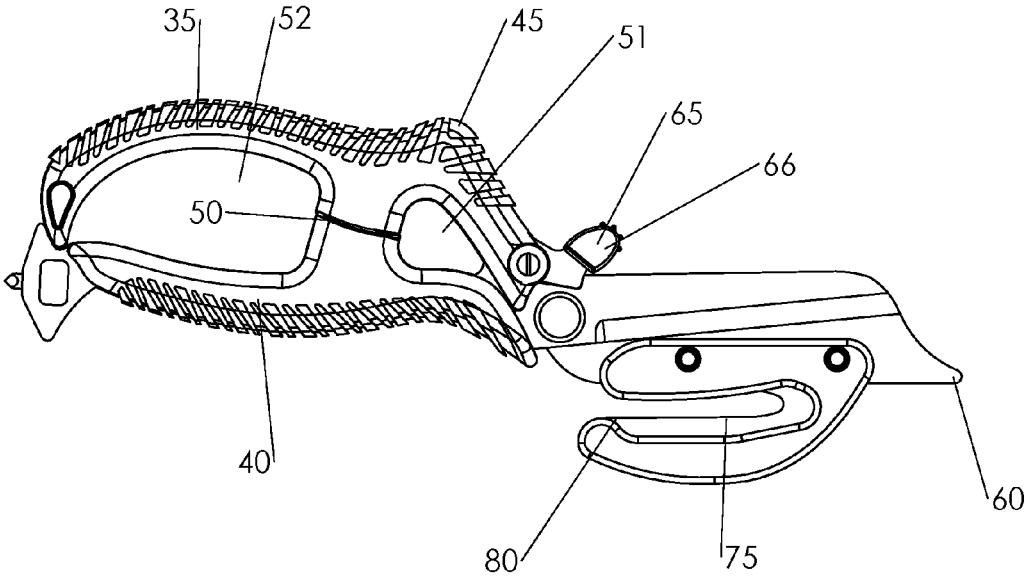
FIG. 6 shows a right side elevation view of an embodiment of the invention.
Figure 7:
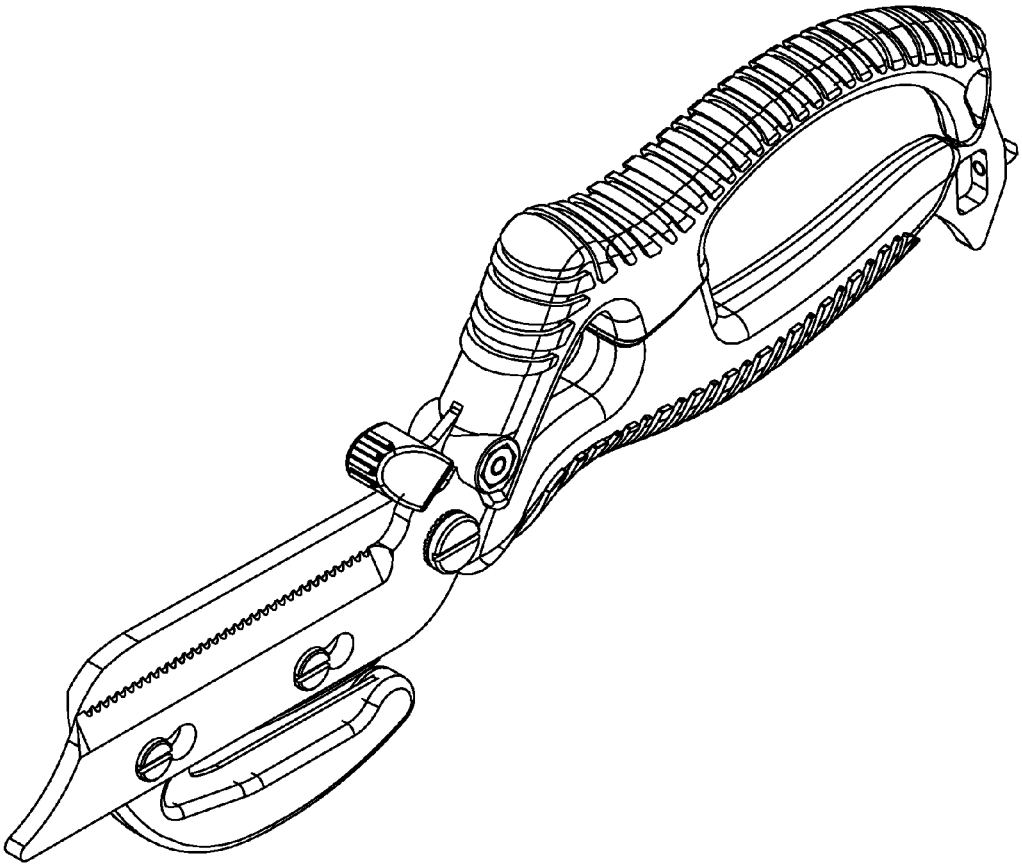
FIG. 7 shows a perspective view of an embodiment of the invention.
Figure 8:
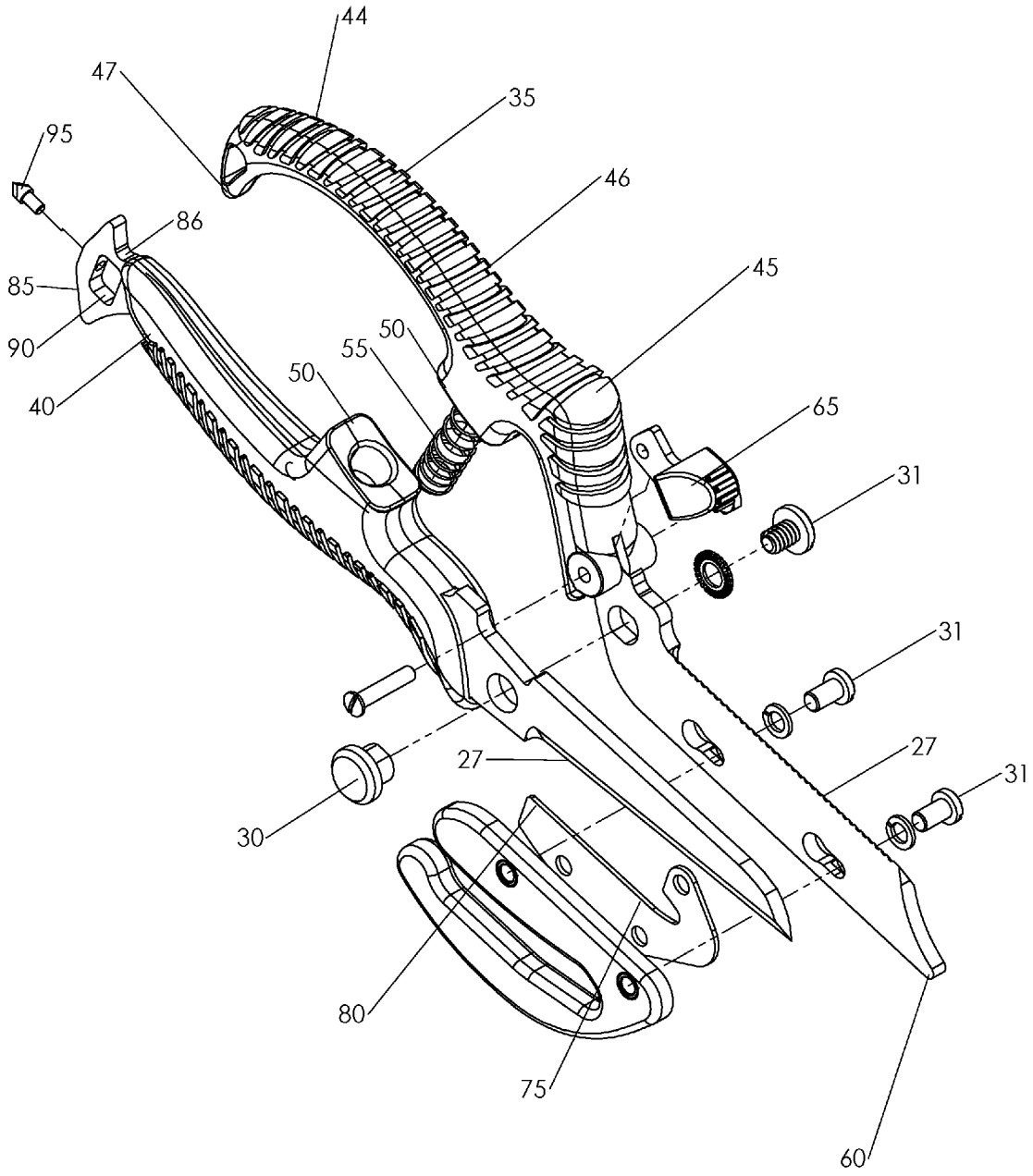
FIG. 8 shows an exploded view of an embodiment of the invention.

20 Shears
21 First lever
22 Second lever
23 Blade end
24 Handle end
25 Domed upper surface
26 Elongate blade end
27 Cutting edge
30 King screw
31 Thumbscrew
35 Upper handle
40 Lower handle
44 Upper handle rear portion
45 Upper handle front portion
46 Upper handle medial portion
47 Upper handle rear portion terminal end
50 Handle stop
51 First opening
52 Second opening
55 Spring
60 Front terminal end
65 Lock
66 Lever lock
75 Ripping blade
80 Lead-in blade
85 Diamond-shaped portion
86 Notch
90 Internal rectangular opening
95 Backwardly projecting removably insertable pointed conical member.

DESCRIPTION

Definitions

A lead-in blade is a blade edge positioned at a front of a series of blade edges that comprise a ripping blade. The lead-in blade performs an initial cut in a sheet of material when the lead-in blade is pulled against the sheet of material, thereby obviating the step of having to first cut the material with the shears prior to ripping with the ripping blade.

A lever lock is a simple lock wherein a locking member is attached to a lever.

Description of the Preferred Embodiment and Best Mode

As shown in the figures, the preferred embodiment and best mode of the present invention comprise a shears 20 having a first lever 21 and a second lever 22, the first lever 21 and second lever 22 being crossed and being pivotally interconnected by a king screw 30, each lever 21, 22 having a blade end 23 and a handle end 24 and being pivotally movable between open and closed conditions and normally biased to the open condition, the shears 20 further comprising:

an upper handle 35 connected to the handle end 24 of the first lever 21 and disposed for engagement in use with a thumb and palm of a user's hand, and a lower handle 40 connected to the handle end 24 of the second lever 22 and disposed for engagement in use with fingers of a user's hand, the upper handle 35 having a domed upper surface 25 formed of a high-friction material and including an upper handle rear portion 44 and an upper handle front portion 45 and an upper handle medial portion 46 between said upper handle front 45 and rear 44 portions, the upper handle front portion 45 projecting upwardly above said upper handle medial portion 46 for engagement with a web between a thumb and forefinger of a user's hand to limit forward movement of a hand along said upper handle 35, the lower handle 40 comprising a lower surface formed of a high-friction material that is downwardly convex and shaped and dimensioned to conform to curled fingers of a user's hand, a lower handle 40 rear portion comprising a diamond-shaped portion 85 comprising an internal rectangular opening 90 and a backwardly projecting removably insertable pointed conical member 95, wherein an upper handle rear portion 44 terminal end 47 fits snugly into a notch 86 in a top of the diamond-shaped portion 85, the upper handle 35 and the lower handle 40 each further comprising a handle stop 50, the handle stops 50 each comprising a recess for receiving a first spring 55 to bias the shears 20 to the open condition, wherein the two handle stops 50 define both a first opening 51 and a second opening 52 between the upper handle 35 and the lower handle 40, and the first spring 55, wherein the first lever 21 is s-shaped such that the upper handle 35 is at a higher elevation than the first lever 21 blade end 23, wherein the lower handle 40 is positioned on a same level as the second lever 22, and wherein the first lever 21 blade end 23 comprises a porpoise nose-shaped terminal end 60.

Optionally, the shears 20 further comprises a lock 65 for securing the blade ends 23 together in a closed position, wherein the lock 65 is pivotably mountable on the upper handle 35.

Optionally, the lock 65 is a lever lock 66.

Optionally, the blade ends 23 are elongate 26.

Optionally, a cutting edge 27 of an elongate 26 blade end 23 measures 2½ inches in length.

Optionally, the king screw 30 is a thumbscrew 31.

Optionally, the shears 20 further comprises a ripping blade 75 detachably mountable to the first lever 21 blade end 23.

Optionally, the ripping blade 75 is detachably mountable to the first lever 21 blade end 23 by means of two thumbscrews 31.

Optionally, the ripping blade 75 has an interior bottom that comprises a lead-in blade 80.

Some advantages of the embodiments of the apparatus were previously enumerated in the Summary section. Every advantageous feature does not need to be incorporated into every embodiment of the apparatus and/or methods.

Although these versions of the invention have been described in considerable detail, other versions are possible. For example, embodiments can comprise combinations of the features described herein, such as combinations of the dependent claims. Therefore, the spirit and scope of the appended claims should not be limited to the description of the versions contained therein.

I claim:

1. A shears having a first lever and a second lever, the first lever and the second lever being crossed and being pivotally interconnected by a king screw, each lever having a blade end and a handle end and being pivotally movable between open and closed conditions and normally biased to the open condition, the shears further comprising:

an upper handle connected to the handle end of the first lever and disposed for engagement in use with a thumb and palm of a user's hand, and a lower handle connected to the handle end of the second lever and disposed for engagement in use with fingers of the user's hand, the upper handle having a domed upper surface formed of a high-friction material and including an upper handle rear portion and an upper handle front portion and an upper handle medial portion between said upper handle front and rear portions, the upper handle front portion projecting upwardly above said upper handle medial portion for engagement with a web between a thumb and forefinger of the user's hand to limit forward movement of the hand along said upper handle, the lower handle comprising a lower surface formed of a high-friction material that is downwardly convex and shaped and dimensioned to conform to curled fingers of the user's hand, a lower handle rear portion comprising a diamond-shaped portion comprising an internal rectangular opening and a backwardly projecting removably insertable pointed conical member, wherein a terminal end of the upper handle rear portion fits snugly into a notch in a top of the diamond-shaped portion, the upper handle and the lower handle each further comprising a handle stop, the handle stops each comprising a recess for receiving a first spring to bias the shears to the open condition, wherein the two handle stops define both a first opening and a second opening between the upper handle and the lower handle, and wherein the first lever is s-shaped such that the upper handle is at a higher elevation than the first lever blade end, wherein the lower handle is at a same elevation as the second lever, and wherein the first lever blade end comprises a porpoise nose-shaped terminal end.

2. The shears of claim 1, further comprising a lock for securing the blade ends together in a closed position, wherein the lock is pivotably mountable on the upper handle.

3. The shears of claim 2, wherein the lock is a lever lock.

4. The shears of claim 1, wherein the blade ends are elongate.

5. The shears of claim 4, wherein a cutting edge of each elongate blade end measures 2½ inches in length.

6. The shears of claim 1, wherein the king screw is a thumbscrew.

7. The shears of claim 1, further comprising a ripping blade detachably mountable to the first lever blade end.

8. The shears of claim 7, wherein the ripping blade is detachably mountable to the first lever blade end by means of two thumbscrews.

9. The shears of claim 7, wherein the ripping blade has an interior bottom that comprises a lead-in blade.

* * * * *